US010019970B2

(12) United States Patent
McLin et al.

(10) Patent No.: US 10,019,970 B2
(45) Date of Patent: Jul. 10, 2018

(54) STEADY COLOR PRESENTATION MANAGER

(71) Applicant: BARCO N.V., Belgium (BE)

(72) Inventors: Matthew R. McLin, Hillsboro, OR (US); Alireza Nasiriavanaki, Portland, OR (US); Albert Frederick George Xthona, Yamhil, OR (US); Tom Kimpe, Landegem (BE)

(73) Assignee: BARCO N.V., Kortrijk (BE)

( * ) Notice: Subject to any disclaimer, the term of this patent is extended or adjusted under 35 U.S.C. 154(b) by 277 days.

(21) Appl. No.: 14/629,557

(22) Filed: Feb. 24, 2015

(65) Prior Publication Data

US 2016/0247488 A1 Aug. 25, 2016

(51) Int. Cl.

| | |
|---|---|
| ***G09G 5/397*** | (2006.01) |
| ***G09G 5/393*** | (2006.01) |
| ***G09G 5/06*** | (2006.01) |
| ***G09G 5/14*** | (2006.01) |

(52) U.S. Cl.

CPC ..... *G09G 5/393* (2013.01); *G09G 5/06* (2013.01); *G09G 5/14* (2013.01); *G09G 2320/0666* (2013.01); *G09G 2320/0693* (2013.01); *G09G 2320/08* (2013.01); *G09G 2340/06* (2013.01); *G09G 2340/14* (2013.01); *G09G 2360/06* (2013.01); *G09G 2360/12* (2013.01); *G09G 2360/145* (2013.01); *G09G 2380/08* (2013.01)

(58) Field of Classification Search

None

See application file for complete search history.

(56) References Cited

U.S. PATENT DOCUMENTS

| | | | | |
|---|---|---|---|---|
| 7,466,447 | B2 | 12/2008 | Stokes et al. | |
| 8,384,722 | B1 | 2/2013 | Tremblay et al. | |
| 2002/0039104 | A1 | 4/2002 | Sato et al. | |
| 2006/0224991 | A1 * | 10/2006 | Stabb | G06F 9/4443 715/781 |
| 2007/0167754 | A1 | 7/2007 | Okuno et al. | |
| 2007/0222730 | A1 * | 9/2007 | Kao | G09G 3/2059 345/89 |
| 2008/0123918 | A1 | 5/2008 | Saotome et al. | |

(Continued)

FOREIGN PATENT DOCUMENTS

| | | |
|---|---|---|
| EP | 1 047 263 A1 | 10/2000 |
| WO | 2013/025688 | 2/2013 |

OTHER PUBLICATIONS

International Search Report dated Jul. 7, 2016 for International Application No. PCT/EP2016/050313.

(Continued)

*Primary Examiner* — Kyle Zhai

(74) *Attorney, Agent, or Firm* — Renner, Otto, Boisselle & Skylar, LLP

(57) ABSTRACT

A system and method for separately processing content provided by different applications that is rendered on an attached display. The content is processed based upon the desired display settings that are appropriate for the particular application delivering content to a particular region of the display. In this way, simultaneously displayed applications may be processed as intended by each application, independent of differences in the display settings assumed by the displayed applications.

17 Claims, 5 Drawing Sheets

(56) References Cited

U.S. PATENT DOCUMENTS

| | | | | |
|---|---|---|---|---|
| 2010/0086230 | A1* | 4/2010 | Bala | H04N 1/603 382/276 |
| 2010/0220048 | A1* | 9/2010 | Yamamura | G09G 3/3426 345/102 |
| 2013/0187958 | A1 | 7/2013 | Kimpe | |
| 2015/0160839 | A1* | 6/2015 | Krishnaswamy | G06F 3/04845 715/810 |
| 2015/0170336 | A1* | 6/2015 | Lapointe | G06T 3/403 382/298 |

OTHER PUBLICATIONS

Partial International Search Report dated Apr. 14, 2016 for International Application No. PCT/EP2016/050313.

Lissner, Ingmar and Phillipp Urban. "Toward a unified color space for perception-based image processing." IEEE Transactions on Image Processing 21.3 (2012): 1153-1168.

* cited by examiner

STEADY COLOR PRESENTATION MANAGER

TECHNICAL FIELD

The present invention relates generally to a display system, and particularly to a method and system for providing display setting management to rendered applications.

BACKGROUND

Many software applications assume that their rendered content will be displayed on a display with Standard RGB (sRGB) color space gamut and luminance response. When this assumption fails (e.g., due to a wide gamut display or a display calibrated to the DICOM grayscale display function), the colors and/or luminance of display content rendered on the display for the application may appear incorrect.

Some applications are capable of using ICC profiles for an attached display so that, when rendered, the application appears as expected. However, many existing applications do not support the use of ICC profiles for output devices. Users of these "non-ICC-aware" applications do not have a means of adjusting the rendered content for the application so that it is properly rendered on the display.

This problem is compounded by the fact that users may need to work simultaneously with multiple non-ICC-aware applications that each expect a different display behaviour.

Use of ICC profiles by ICC-aware applications can be computationally expensive, in particular for those ICC profiles providing large 3D color lookup tables (CLUTs). In fact, central processing units (CPUs) are often not able to process rendered frames for ICC-aware applications with ICC profiles fast enough to keep up with animated or moving images.

SUMMARY

The present disclosure addresses the above problems by separately processing regions of the display based upon the display settings that are appropriate for the particular application delivering content to that region of the display. In this way, content (e.g., windows) generated by different applications are transformed such that the content is rendered as intended (even on displays with properties that do not match the display properties expected by the applications).

According to one aspect of the disclosure, there is provided a display system for modifying content of a frame buffer prior to displaying the content of the frame buffer on a display. The display system is configured to: receive the content of the frame buffer; determine a plurality of regions present in the content of the frame buffer which represent content provided by at least one process; for each determined region, determine desired display settings for the content of the frame buffer located in the determined region; and process the received content of the frame buffer to generate processed frame buffer content. The processing includes, for each determined region present in the content of the frame buffer, determining a processing procedure to modify the content of the determined region such that, when visualized on the display, properties of the content of the determined region coincide with the desired display settings for the determined region. The processing also includes, for each determined region present in the content of the frame buffer, processing the determined region using the determined processing procedure to generate processed frame buffer content. The display system is also configured to supply the generated processed frame buffer content to the display.

Alternatively or additionally, determining the processing procedure comprises determining a type of processing to perform on the content of the frame buffer and determining a data element that, when used to process the content of the frame buffer, performs the determined the type of processing.

Alternatively or additionally, determining the plurality of regions of the frame buffer comprises a user identifying a region and, for each identified region, the user selects desired display settings.

Alternatively or additionally, the desired display settings for a particular determined region are determined based on characteristics of the particular determined region.

Alternatively or additionally, the characteristics of the particular region include at least one of: whether pixels in the particular region are primarily greyscale, primarily color, or a mix of greyscale and color; or a name of the process controlling rendering of the particular region.

Alternatively or additionally, each determined region comprises a geometric shape or a list of pixels representing the content provided by the at least one process.

Alternatively or additionally, the processing procedure comprises at least one of color processing or luminance processing.

Alternatively or additionally, the processing procedure includes luminance processing, which includes applying a luminance scaling coefficient that is computed as the ratio of a requested luminance range to a native luminance range of the display.

Alternatively or additionally, the desired display settings for a particular determined region are based on sRGB, DICOM GSDF, or gamma 1.8.

Alternatively or additionally, the determined data element for processing comprises a first transformation element and processing a particular region using the first transformation element. The first transformation element is a three-dimensional (3D) LUT and the content of the 3D LUT is computed from the desired display settings and data stored in an ICC profile for the display.

Alternatively or additionally, the determined data element for processing further comprises a second transformation element and processing the particular region using the first transformation element comprises: processing the particular region using the second transformation element to generate a resultant region and processing the resultant region using the first transformation element. The second transformation element is three one-dimensional (1D) lookup tables (LUTs) and the three 1D LUTs are computed from a mathematical model of the desired display settings.

Alternatively or additionally, the display includes a physical sensor configured to measure light emitting from a measurement area of the display. The display system varies in time the region of the content of the frame buffer displayed in the measurement area of the display. The physical sensor measures and records properties of light emitting from each of the determined regions.

According to another aspect of the disclosure, there is provided a method for modifying content of a frame buffer prior to displaying the content of the frame buffer on a display. The method includes: receiving the content of the frame buffer; determining a plurality of regions present in the content of the frame buffer which represent content provided by at least one process; for each determined region, determining desired display settings for the content of the frame buffer located in the determined region; and generating processed frame buffer content by processing the received content of the frame buffer. The processing includes, for each determined region present in the content of the frame buffer, determining a processing procedure to modify the content of the determined region such that, when visualized on the display, properties of the content of the determined region coincide with the desired display settings for the determined region. The processing also includes, for each determined region present in the content of the frame buffer, processing the determined region using the determined processing procedure to generate processed frame buffer content. The method additionally includes supplying the generated processed frame buffer content to a display.

Alternatively or additionally, determining the processing procedure includes determining a type of processing to perform on the content of the frame buffer and determining a data element that, when used to process the content of the frame buffer, performs the determined the type of processing.

Alternatively or additionally, determining the plurality of regions of the frame buffer comprises a user identifying a region and, for each identified region, the user selects desired display settings.

Alternatively or additionally, the desired display settings for a particular determined region are determined based on characteristics of the particular determined region.

Alternatively or additionally, the characteristics of the particular region include at least one of: whether pixels in the particular region are primarily greyscale, primarily color, or a mix of greyscale and color; or a name of the process controlling rendering of the particular region.

Alternatively or additionally, the processing procedure comprises at least one of color processing or luminance processing.

Alternatively or additionally, the determined data element for processing include a first transformation element and processing a particular region comprises using the first transformation element. The first transformation element is a three-dimensional (3D) LUT and the content of the 3D LUT is computed from the desired display settings and data stored in an ICC profile for the display.

Alternatively or additionally, the determined data element for processing further comprising a second transformation element. Processing the particular region using the first transformation element includes processing the particular region using the second transformation element to generate a resultant region and processing the resultant region using the first transformation element. The second transformation element is three one-dimensional (1D) lookup tables (LUTs) and the three 1D LUTs are computed from a mathematical model of the desired display settings.

Alternatively or additionally, the method includes recording measurements of light emitted from a measurement area of the display using a physical sensor, varying in time the region of the content of the frame buffer displayed in the measurement area of the display, and recording properties of light emitting from each of the determined regions.

The foregoing and other features of the invention are hereinafter fully described and particularly pointed out in the claims, the following description and annexed drawings setting forth in detail certain illustrative embodiments of the invention, these embodiments being indicative, however, of but a few of the various ways in which the principles of the invention may be employed.

Features that are described and/or illustrated with respect to one embodiment may be used in the same way or in a similar way in one or more other embodiments and/or in combination with or instead of the features of the other embodiments.

DETAILED DESCRIPTION

In the text as follows, a "display system" is a collection of hardware (displays, display controllers, graphics processors, processors, etc.), a "display" is considered to be a physical display device (e.g., a display for displaying 2D content, a display for displaying 3D content, a medical grade display, a high-resolution display, a liquid crystal display (LCD), cathode ray tube (CRT) display, plasma display, etc.), a "frame buffer" is a section of video memory used to hold the image to be shown on the display.

Figure 1:
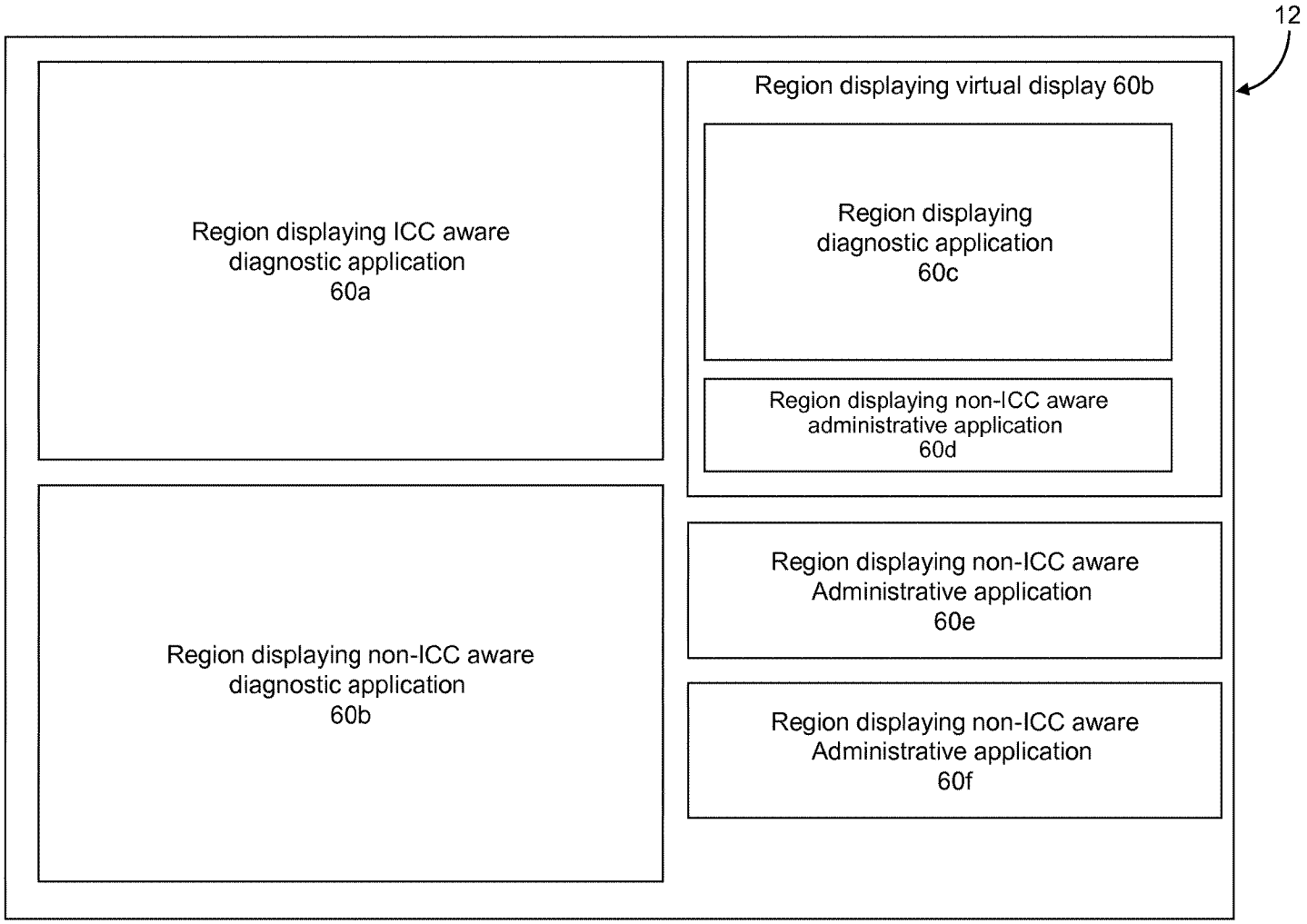
FIG. 1 shows a display including multiple windows having content provided by different applications.

Turning to FIG. 1, a physical display 12 is shown that is displaying multiple regions 60*a-f* including content from different applications. For example, region 60*a* of the display 12 includes content generated by a diagnostic application that is aware of the ICC profile of the display 12, while region 60*e* includes content generated by an administrative application that is unaware of the ICC profile of the display 12. Displaying both diagnostic and administrative applications is a common occurrence in medical environments, where applications often display content that requires a diagnostic level of brightness, while at the same time displaying content from administrative (non-diagnostic) applications. This can cause a problem, because diagnostic applications often require higher levels of brightness than are required for administrative applications. Always offering a diagnostic (high) level of brightness may not be a viable solution, because many administrative applications use white backgrounds that generate extreme levels of brightness when shown on a diagnostic display. These high levels of brightness may cause issues for users attempting to evaluate medical images.

In additional to including both diagnostic and administrative applications, FIG. 1 includes content from a logical display and a virtual display. The different types of applications hosted by the logical display and the virtual display often assume different levels of brightness. Further compounding the problem, a region displaying a virtual display 60*b* may include regions 60*c*, 60*d* having content generated by different types of applications.

The present disclosure provides a system and method for separately processing content rendered on an attached display. The content (e.g., windows) is provided by different applications. The method and system process the content based upon the display settings that are appropriate for the particular application delivering content to that region of the display. In this way, simultaneously displayed applications (e.g., as shown in FIG. 1) may be processed as intended by each application, independent of differences in the display settings assumed by the displayed applications.

Figure 2:
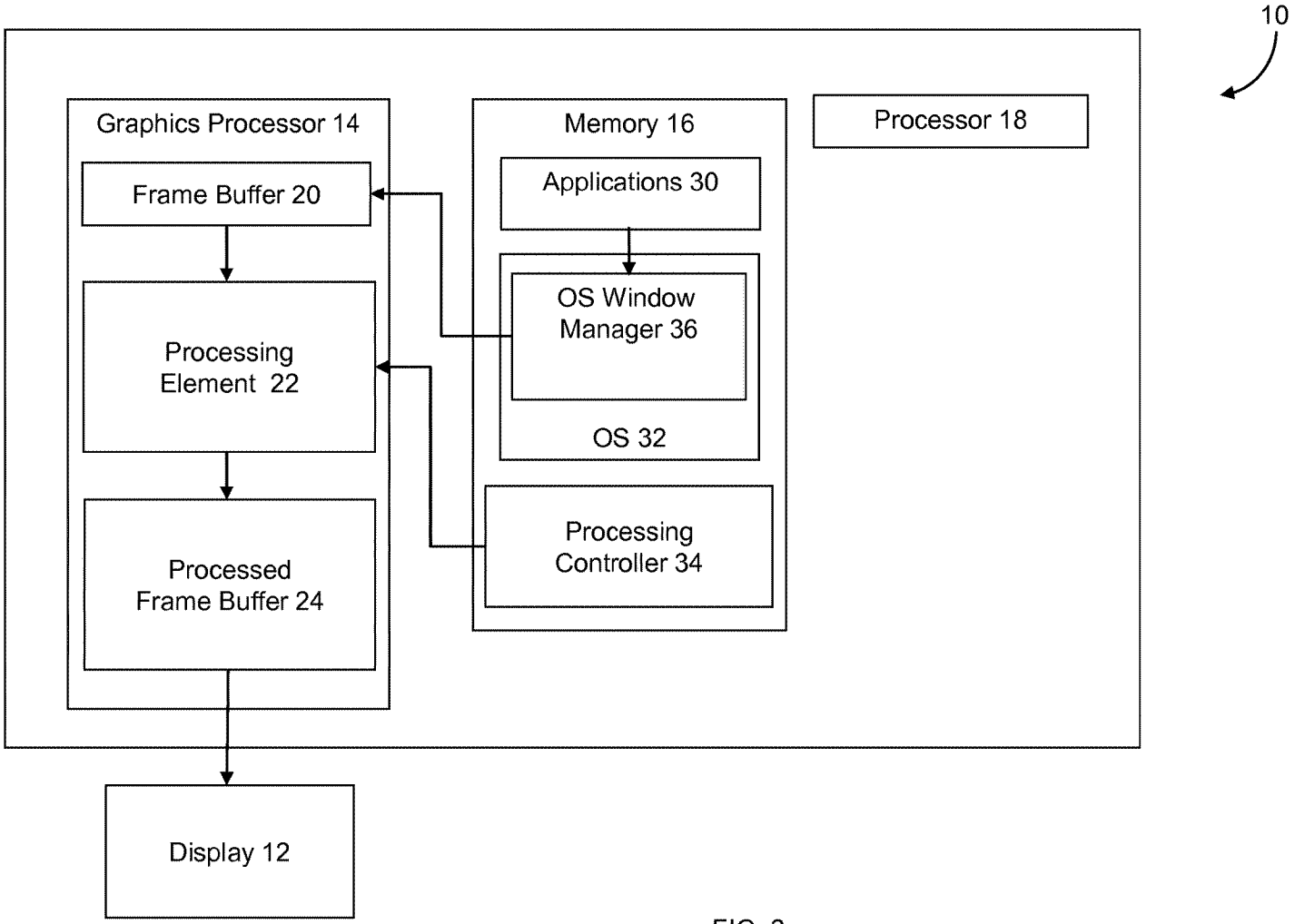
FIG. 2 depicts a display system for modifying content of a frame buffer prior to displaying the content of the frame buffer on a display.

Turning to FIG. 2, an exemplary display system 10 is shown. The display system 10 includes an attached display 12 and at least one processor 14, 18. The at least one processor may include a processor 18 and a graphics processor 14. The display system 10 may also include a non-transitory computer readable medium (memory) 16 and a processor 18. The memory 16 may store applications 30, the operating system (OS) 32, and a processing controller 34 that may be executed by the processor 18. When executed by the processor 18, the applications 30 may generate content to be displayed. The display content is provided to the OS window manager 36, which passes the content to a frame buffer 20. The frame buffer 20 is part of the graphics processor 14 and stores display content to be displayed on the display 12. The graphics processor 14 may also include processing elements 22 and a processed frame buffer 24. The processing elements 22 may be controlled by the processing controller 34. The processing elements 22 are located between the framebuffer 20 of the display system 10 and the framebuffers of the attached display 12. The processing elements 22 receive content from the frame buffer 20 and process the content of the frame buffer 20 before passing the processed content to the display 12. In this way, the content rendered on the display 12 is processed by the processing elements 22 of the graphics processor 14 prior to being rendered on the display.

As will be understood by one of ordinary skill in the art, the graphics processor 14 may be an integrated or a dedicated graphics processing unit (GPU) or any other suitable processor or controller capable of providing the content of the frame buffer 20 to the display 12.

As described above, the graphics processor 14 is configured to receive the content of the frame buffer 20. The content may include frames to be displayed on one or more physical displays. When multiple attached displays are present, a separate instance of the processing elements 22 may be present for each attached display. For example, if the display system 10 includes two attached displays 12, then the graphics processor 14 may include a first and second processing element 22.

The processing controller 34 is responsible for directing the processing performed by each of the processing elements 22. The processing controller 34 identifies a plurality of regions 60 within the framebuffer 20. Each region 60 represents a content provided by at least one process. Each region 60 may comprise, e.g., a window. Each region 60 may specify a geometric shape or a list of pixels representing the content provided by the at least one process. A process may refer to an application or program that generates content to be rendered on the display 12.

The plurality of regions 60 of the frame buffer 20 may be determined by a user. For example, a control panel may be displayed to the user that allows the user to identify regions that represent content provided by one or more processes.

Alternatively, the plurality of regions 60 may be automatically determined. For example, each region 60 present in the content of the frame buffer 20 representing content provided by different processes may be identified. The regions 60 may be identified by interrogating the OS window manager 36. Each identified region 60 may be displayed as a separate window. However, multiple regions (e.g., represented by separate windows) may be combined into a single region. For example, regions may be combined if the regions are generated by the same process, the regions are generated by processes known to require the same display properties, etc.

After determining the plurality of regions 60, desired display settings are determined for the content of the frame buffer 20 located in each determined region. The desired display settings may be provided by a user. For example, the control panel that allows a user to identify the regions 60 may also allow a user to assign desired display settings for the regions 60. The display settings may include, e.g., a desired display output profile and desired luminance. The desired display settings indicate the profile of the display 12 expected by the application responsible for rendering the content of the frame buffer 20 located in the particular region 60. For example, a photo viewing application may assume that its images are being rendered on a display 12 with a sRGB profile, and therefore convert all images it loads to the sRGB color space. By selecting "sRGB" as the desired display settings, the rendered content of the application may be processed such that it appears as intended on calibrated displays for which, e.g., an ICC profile is available.

Alternatively, the desired display settings may be determined automatically. For example, the desired display settings for a particular region may be determined based upon characteristics of the particular region. The characteristics of the particular region may include whether pixels in the particular region are primarily greyscale, primarily color, or a mix of greyscale and color. The characteristics of the particular region may alternatively or additionally include a name of the process controlling rendering of the particular region.

In one example, regions rendered as pure greyscale pixels may have their display settings calibrated to the DICOM grayscale standard display function (GSDF) curve. Similarly, all applications that have rendered content with more than 80% of the pixels in color may have desired display settings corresponding to the sRGB standard. In another example, all other applications may have desired display settings corresponding to gamma 1.8.

The desired display settings may also be determined automatically using the name of the process controlling rendering of the particular region. In this example, the memory 16 may include a database listing identifying process names associated with desired display settings. The processing controller 34 may determine which regions are being rendered by which processes and set the appropriate desired display settings for each region by applying the desired display settings as specified in the database. Processes that do not appear in the database may be set to a default desired display setting (e.g. based on DICOM GSDF or sRGB). As will be understood by one of ordinary skill in the art, the database may be managed locally or globally.

After determining the desired display settings for each determined region, the content of the frame buffer 20 is processed to generate processed frame buffer content. Processing the content of the frame buffer 20 includes, for each determined region present in the content of the frame buffer 20, determining a processing procedure to modify properties of the content of the determined region to coincide with the determined desired display settings for the region. That is, a processing procedure is determined that will modify the properties of the content of the determined region to match the determined desired display settings for the region. Matching the properties of the content of the determined region and the desired display settings may not require the properties to exactly match the display settings. Rather, the properties of the content may be processed to approximately match the desired display settings. "Approximately match" may refer to the properties of the content matching within at least 25%, at least 15%, or at least 5% the desired display settings. For example, if the desired display setting specify 500 lumens, the properties of the content may be modified to be within 15% of 500 lumens (e.g., 425 lumens to 575 lumens).

Determining the processing procedure for a particular determined region may include determining a type of processing to perform. For example, the type of processing may include at least one of color processing or luminance processing. The type of processing may be determined based upon the desired display settings for the particular determined region and the known properties of the display 12. For example, the display 12 may store an ICC profile for the display 12. The type of processing may be determined based upon differences between the ICC profile for the display 12 and the desired display settings for the particular determined region. For example, the differences between the desired display settings for the particular region and the ICC profile for the display 12 may require only linear processing, only non-linear processing, or both linear and non-linear processing.

The processing procedure to perform for each determined region may include a number of processing steps necessary to modify properties of the content for the particular determined region to coincide with the desired display settings for the particular region.

In addition to determining the type of processing, determining the processing procedure to perform for each identified region may additionally include determining a data element 70 that, when used to process the content of the frame buffer 20, performs the determined type of processing.

In one example, the type of processing for a particular determined region is luminance processing, which includes luminance scaling. The processing procedure includes applying a data element 70 that includes a luminance scaling coefficient. The data element 70 (i.e., the luminance scaling coefficient) is determined based upon a requested luminance range that is part of the desired display settings. In particular, the luminance scaling coefficient is computed as the ratio of the requested luminance range to a native luminance range of the display 12. The native luminance range of the display 12 may be determined by an ICC profile for the display 12.

Luminance correction may be performed on a display 12 having a response following the DICOM GSDF by applying a data element 70 including a single luminance scaling coefficient. The DICOM GSDF ensures that drive level values are proportional to display luminance in just noticeable differences (JNDs). The coefficient (c) applied to such a display 12 may be computed as follows:

$$c = \frac{Y2JND(newLum) - Y2JND(\min Lum)}{Y2JND(\max Lum) - Y2JND(\min Lum)}$$

where:

newLum=desired maximum luminance specified in display settings;

minLum=minimum displayable luminance (e.g., considering ambient light) as specified in display settings;

maxLum=maximum displayable luminance; and

Y2JND(L)=inverse of the GSDF JND to luminance function, as provided by the following formula from page 12 of the DICOM GSDF spec:

$$j(L)=A+B\ \mathrm{Log}_{10}(L)+C(\mathrm{Log}_{10}(L))^2+D(\mathrm{Log}_{10}(L))^3+E(\mathrm{Log}_{10}(L))^4+F(\mathrm{Log}_{10}(L))^5+G(\mathrm{Log}_{10}(L))^6+H(\mathrm{Log}_{10}(L))^7+I(\mathrm{Log}_{10}(L))^8$$

where, A=71.498068, B=94.593053, C=41.912053, D=908247004, E=0.28175407, F=−1.1878455, G=−0.1801439, H=0.14710899, I=−0.017046845.

Figure 3:
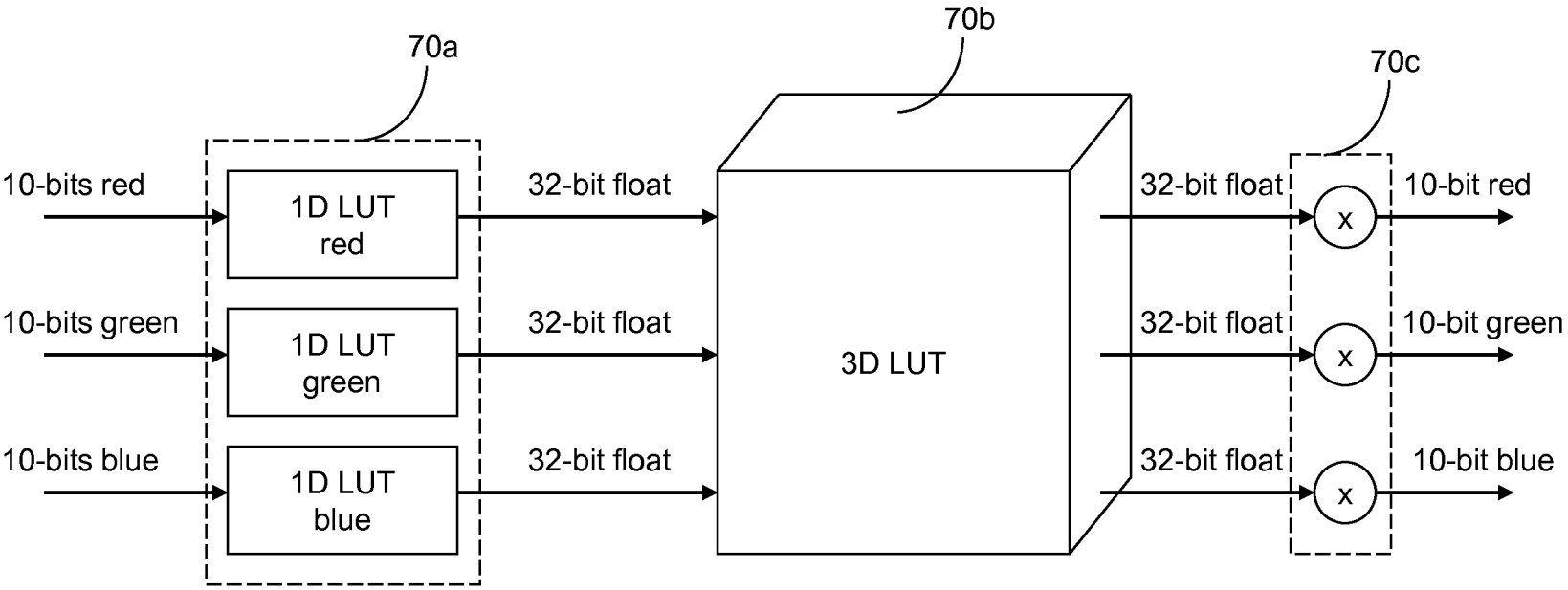
FIG. 3 shows an exemplary processing procedure performed by the display system of FIG. 2.

In the example shown in FIG. 3, the processing procedure for a particular determined region includes linear color processing and non-linear luminance processing. The data element 70 for this processing procedure may include a first transformation element 70*a* used to perform the linear color processing and a second transformation element 70*b* used to perform the non-linear luminance processing. Processing a particular region may comprise first processing the particular region using the first transformation element 70*a* to generate a first resultant region. Next, the first resultant region may be processed using the second transformation element 70*b*.

The first transformation element 70*a* may be three one-dimensional (1D) lookup tables (LUTs). The three 1D LUTs may be chosen to provide the per-color-channel display response specified in the desired display settings for the particular determined region. The first transformation element 70*a* may be computed from a mathematical model of the desired display settings and a profile of the display 12. The three 1D LUTs may take 10-bit-per-channel values as an input and provide 32-bit-float values for each channel as an output.

The second transformation element 70*b* may be a three-dimensional (3D) LUT. The 3D LUT may be computed to invert the non-linear behavior of the display 12 to be linear in the particular determined region. Each entry in the 3D LUT may contain three color channels for red, green, and blue, each represented at 10-bits per channel. The second transformation element 70*b* may have a size of 32×32×32. Tetrahedral interpolation may be applied to the second transformation element in order to estimate color transformation for color values not directly represented by the second element 70*b*. The content of the 3D LUT may be computed from data stored in the ICC profile of the display 12 and the display settings.

The net effect of processing a particular region using the first and second transformation elements 70*a*, 70*b* is a perceptual mapping of the desired display gamut (e.g., sRGB) specified in the display settings to the display's actual gamut. When the gamut of the display 12 and the gamut specified in the desired display settings differ significantly, it may be necessary to perform an additional correction in the 1D or 3D LUTs that takes into account the colors that are outside the displayable gamut. For example, one approach is to apply a compression of chrominance in Lab space (such that the colors within the displayable gamut are preserved to the extent possible). In the compression, the chrominance of colors near the gamut boundary are compressed (while preserving luminance) and colors outside the gamut are mapped to the nearest point on the gamut surface.

As shown in FIG. 3, the data element 70 may additionally include a luminance scale factor 70*c*. The luminance scale factor 70*c* may be used to process the result of the second transformation element 70*b*.

While the above processing is described using three 1D LUTs and a 3D LUT, other embodiments may change the roles of each LUT, remove one of the LUTs entirely, or add additional LUTs or processing steps as necessary to process the content of the particular region to match as close as possible the desired display settings.

The content of the three 1D LUTs may be computed from a mathematical model of the desired display settings. The content of the 3D LUT may be computed from data stored in the ICC profile of the display 12 that describes how to compute the necessary driving level to achieve a desired color output (e.g., using the BtoA1 relative colorimetric intent tag). For example, the second transformation element 70*b* may be generated by computing the inverse of a 3D LUT that is programmed into the display 12 to achieve its calibrated behavior. For improved performance and quality, the 3D LUT may be pre-computed and directly stored into the ICC profile of the display 12.

In addition to determining the processing procedure, processing the content of the frame buffer 20 also includes, for each determined region, processing the determined region using the determined processing procedure to generate processed frame buffer content. The processed frame buffer content may then be placed into the generated processed frame buffer 24. Alternatively, the processed frame buffer content may be placed into the frame buffer 20. In either case, the processed frame buffer content is supplied to the display 12.

Processing the frame buffer 20 may be iteratively performed for each frame. That is, the same processing procedure may be repeatedly performed for each frame. The processing procedure may be maintained until the frame-buffer changes. That is, the frame buffer 20 may be monitored for a change in the properties of the regions 60. For example, the frame buffer 20 may be monitored to detect a change in the location or size of at least one of the regions 60. When a change in the regions 60 is detected, the regions present in the content of the frame buffer 20 may be determined, again the desired display settings for the newly determined regions 60 may be determined, and the content of the frame buffer 20 may again be processed to generate the processed frame buffer. The desired display settings and the processing procedure may only be determined for new regions or regions with different properties. For example, if a new window is opened, the desired display settings and the processing procedure may only be determined for the new window while the desired display settings and processing procedure for the previously determined regions may be unchanged.

Figure 4:
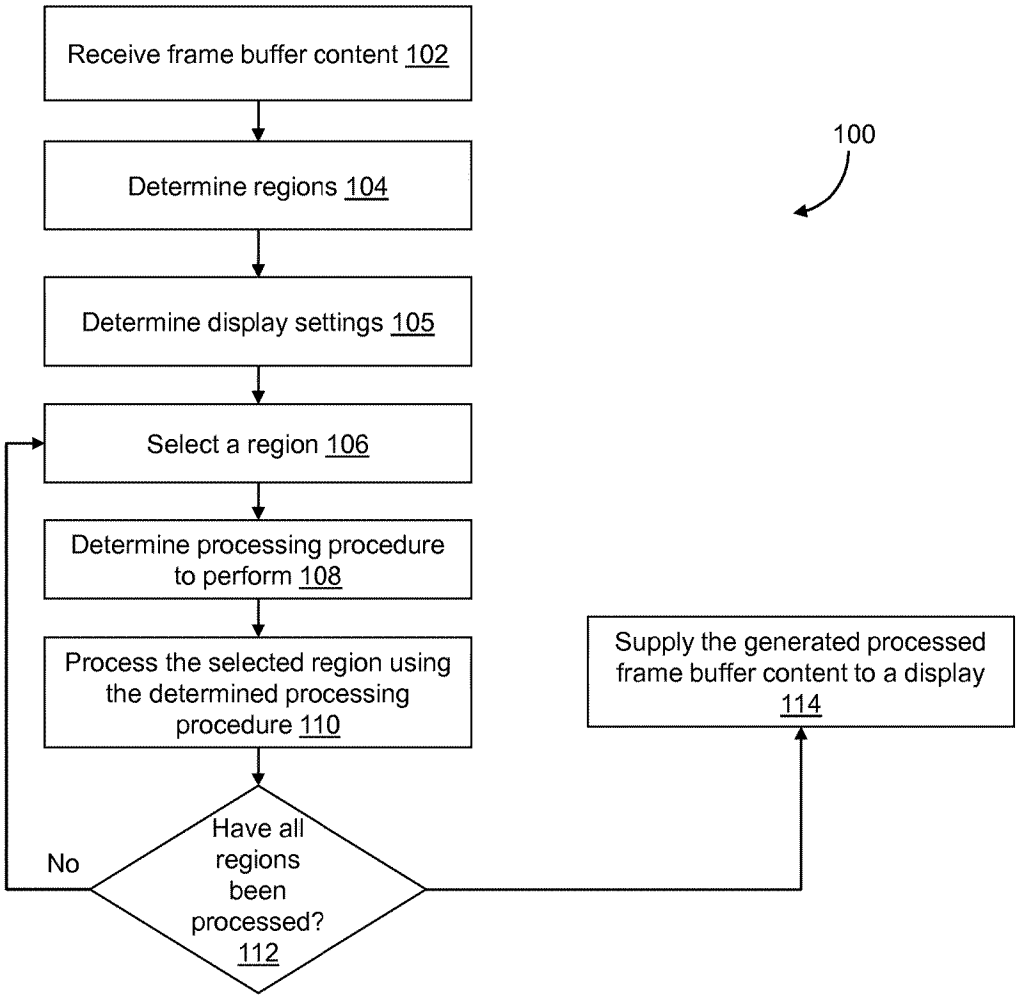
FIG. 4 depicts a method for modifying content of a frame buffer prior to displaying the content of the frame buffer on a display.

Turning to FIG. 4, a flow diagram for a method for modifying content of a frame buffer 20 prior to displaying the content of the frame buffer 20 on a display 12 is shown. As will be understood by one of ordinary skill in the art, the method may be performed by the at least one processor 14, 18. For example, the method may be performed by a processing controller program stored in a non-transitory computer readable medium 16, which, when executed by the processor 18 and/or graphics processor 14, causes the processor 18 and/or the graphics processor 14 to perform the method.

In process block 102, the content of the frame buffer 20 is received. The content of the frame buffer 20 may be received by the graphics processor 14. In process block 104, the plurality of regions present in the content of the frame buffer 20 are determined. In process block 105, desired display settings are determined for each determined region. Process blocks 104 and 105 may be performed by the processor 18.

In process block 106, a given determined region is selected. In process 108, the processing procedure to perform is determined. For example, as described above, determining the processing procedure may be determined based upon the desired display settings for the given determined region and a profile of the display 12. Process block 106 and 108 may be performed by the processor 18. In process block 110, the given determined region is processed using the determined processing procedure. Processing of the given determined region may be performed by the processing elements 22 of the graphics processor 14.

In decision block 112, a check is performed to determine if all regions have been processed. If there exists any regions that have not yet been processed, then processing returns to process block 106, where an unprocessed region is selected. Alternatively, if all of the regions have been processed 112, then the generated processed frame buffer content is supplied to the display 12 by the graphics processor 14

Using the method 100 described above, a user may indicate desired display settings for particular applications and the content of these applications may be processed regardless of their location on the display 12. The method does not depend upon the capabilities of the applications and does not require any involvement from the application vendor.

The method 100 may be accelerated using parallel computing hardware in the graphics processor 14. By utilizing the graphics processor 14 to execute aspects of the method 100, it is possible to process frame buffer content and keep up with 60 Hertz (Hz) display refresh rates even for large resolutions and/or multiple displays 12.

Figure 5:
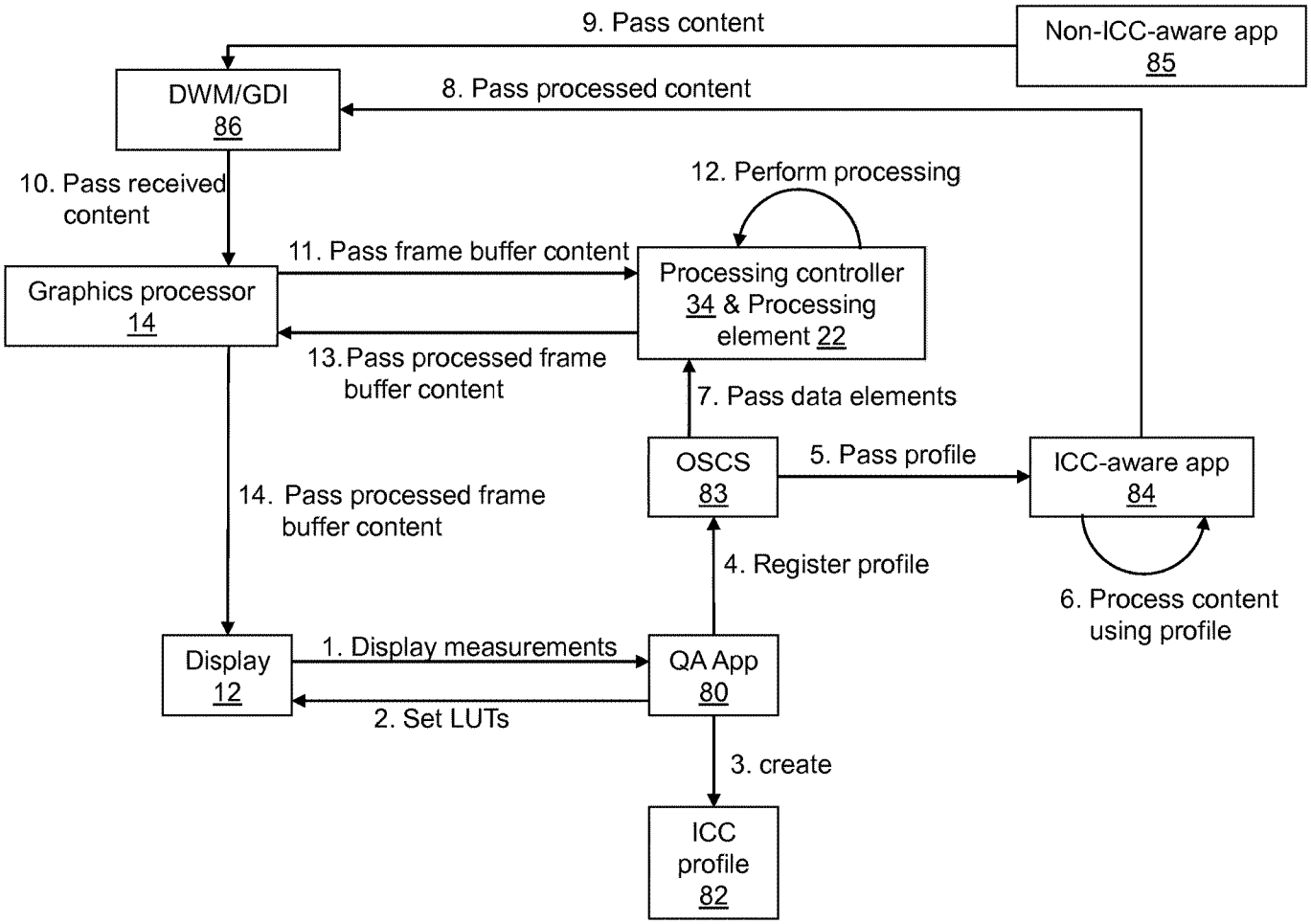
FIG. 5 shows an overview of the flow of data in one embodiment of the display system of FIG. 2.

Turning to FIG. 5, an overview of the flow of data in one embodiment of the system is shown. Beginning at the display 12, display measurements are passed to a QA management application 80. The QA management application 80 sets LUTs for the display 12 and passes the LUTs back to the display 12 for storage. The QA management application 80 additionally creates an ICC profile 82 for the display 12. The ICC profile 82 may include inverse LUTs (i.e., data elements 70) for processing of frame buffer content. The QA management application 80 registers the created ICC profile 82 with an OS Color System (OSCS) 83. The OSCS provides APIs for applications to indicate color profile information from source devices and also for destination devices, and APIs to request that the OS (or any registered color management module) perform the necessary color transformations, including transforming images to intermediate color spaces.

The OSCS 83 passes the ICC profile 82 to any ICC-aware application(s) 84. The ICC-aware application(s) 84 render content that is passed to a Desktop Window Manager/Graphics Device Interface (DWM/GDI) 86 that is part of the OS. Non-ICC-aware applications 85 similarly render content that is passed to the DWM/GDI 86. The DWM/GDI 86 passes the received content to the graphics processor 14, which places the content in the frame buffer 20.

The graphics processor 14 passes the content of the frame buffer 20 to the processing controller 34 and the processing element 22. The OSCS 83 passes the data elements 70 from the ICC profile 82 to the processing controller 34 and the processing element 22. The processing controller 34 and the processing element 22 perform the method 100 described above and return generated processed frame buffer content to the graphics processor 14. The graphics processor 14 then passes the processed frame buffer content to the display 12, which displays the processed frame buffer content.

Applications running in a Virtual Desktop Infrastructure (VDI) are typically unable to obtain the color profile for the remote display on which the applications are displayed. This is true regardless of whether the applications are non-ICC aware or ICC-aware. This can be especially problematic when multiple users may be viewing the same virtual session using different displays. In this case, it is not possible for typical applications to provide specific desired display settings by processing the display content being delivered, because different processing is required for each client. As will be understood by one of ordinary skill in the art, a virtual display may be a remote desktop connection, a window to a virtual machine, or belong to a simulated display.

The display system 10 solves this problem by performing processing using the graphics processor 14 of the remote computer receiving the display content. For example, a user of the client may use the control panel described above to select an appropriate color profile for the region hosting the remote session. This profile may apply to all applications in the remote session. Alternatively, a user may use the control panel to select an appropriate color profile for each region rendered in the remote session. In this way, the region present in the remote session may be displayed as expected by the rendering applications.

Screen captures are a common means for capturing and sharing image content for viewing on other display systems. In order to ensure accurate reproduction of the screen capture on other systems, the display system 10 embeds an ICC profile in the screen capture that corresponds to the display 12 used at the time of the screen capture. By embedding the ICC profile in the screen capture, it is possible for a different display system to process the screen capture such that a reproduction of the screen capture rendered on the different display system is faithful to the screen capture. This is true even when the screen capture includes multiple applications with different desired display settings.

It is especially important for healthcare applications that images are rendered correctly. Traditionally medical displays have used display calibration and display quality assurance (QA) checks to ensure that a display system is rendering applications or images as expected. However, in situations with multiple non-ICC aware applications it is not possible to accurately calibrate the display of each non-ICC aware application, because QA checks are performed on the display 12 as a whole (i.e., not for individual applications rendered on the display 12). A solution is needed that allows efficient calibration and QA checks of display systems that will be used to render multiple non-ICC-aware applications simultaneously on the same display.

Some countries, by law or regulation, require a periodic calibration and QA check to prove that images viewed on a display meet a minimum quality requirement. Calibration and quality assurance (QA) checks are typically performed on a "display level", meaning that the display is calibrated as a whole to one single target and QA checks are performed for the display as a whole. A calibration and/or QA check performed in this manner can only show that applications that correspond to the calibration target the display 12 was calibrated for were correctly visualized. For all other applications there is no guarantee, nor proof that the applications/images were correctly visualized.

If the contents of the frame buffer 20 is composed of multiple virtual displays, or if the frame buffer contents contains multiple applications with different display requirements, then it is necessary to perform a QA check for each region. This is often not possible, because sensors used to perform QA checks typically can only measure performance of the display at one static location on the display 12.

In one embodiment, the display includes a physical sensor configured to measure light emitting from a measurement area of the display. In order to calibrate the display 12 using the sensor for regions generated by different applications, the area under the sensor is iterated to display different regions. That is, the display system varies in time the region of the content of the frame buffer displayed in the measurement area of the display. This automatic translation of the region displayed under the sensor allows the static sensor to measure the characteristics of each displayed region. In this way, the physical sensor measures and records properties of light emitting from each of the determined regions. Using this method, calibration and QA reports may be generated that include information for each application responsible for content rendered in the content of the frame buffer 20. One method for driving the calibration and QA is to post-process measurements recorded by the sensor with the processing that is applied to each measured region. An alternative method for driving the calibration and QA is to pre-process each rendered region measured by the sensor.

In order to stop the calibration and QA checks from becoming very slow (because of the large number of measurements needed to support all of the different regions), a system of caching measurements may be utilized. For the different display settings that need to be calibrated/checked, there may be a number of measurements in common. It is not efficient to repeat all these measurements for each display as setting since this would take a lot of time and significantly reduce speed of calibration and QA as a result. Instead, what is done is that a "cache" will be kept of measurements that have been performed. This cache contains a timestamp of the measurement, the specific value (RGB value) that was being measured, together with boundary conditions such as backlight setting, temperature, ambient light level, etc.). If a new measurement needs to be performed, the cache is inspected to determine if new measurement (or a sufficiently similar measurement) has been performed recently (e.g., within one day, one week, or one month). If such a sufficiently similar measurement is found, then the measurement will not be performed again, but the cached result will instead be used. If no sufficiently similar measurement is found in the cache (e.g., because the boundary conditions were too different or because there is a sufficiently similar measurement in cache but that is too old), then the physical measurement will be performed and the results will be placed in cache.

As will be understood by one of ordinary skill in the art, the processor 18 may have various implementations. For example, the processor 18 may include any suitable device, such as a programmable circuit, integrated circuit, memory and I/O circuits, an application specific integrated circuit, microcontroller, complex programmable logic device, other programmable circuits, or the like. The processor 18 may also include a non-transitory computer readable medium, such as random access memory (RAM), a read-only memory (ROM), an erasable programmable read-only memory (EPROM or Flash memory), or any other suitable medium. Instructions for performing the method described below may be stored in the non-transitory computer readable medium and executed by the processor. The processor 18 may be communicatively coupled to the computer readable medium 16 and the graphics processor 14 through a system bus, mother board, or using any other suitable structure known in the art.

As will be understood by one of ordinary skill in the art, the display settings and properties defining the plurality of regions may be stored in the non-transitory computer readable medium 16.

The present disclosure is not limited to a specific number of displays. Rather, the present disclosure may be applied to several virtual displays, e.g., implemented within the same display system.

The invention claimed is:

1. A display system for modifying content of a frame buffer prior to displaying the content of the frame buffer on a display, the display system configured to:

receive the content of the frame buffer;

determine a plurality of regions present in the content of the frame buffer which represent content provided by at least one process;

for each determined region, determine desired display settings for the content of the frame buffer located in the determined region;

process the received content of the frame buffer to generate processed frame buffer content, the processing comprising:

for each determined region present in the content of the frame buffer:

determining a processing procedure to modify the content of the determined region such that, when visualized on the display, properties of the content of the determined region coincide with the desired display settings for the determined region;

processing the determined region using the determined processing procedure to generate processed frame buffer content;

supply the generated processed frame buffer content to the display;

wherein, for a particular region of the determined regions:

determining the processing procedure includes determining a type of processing to perform on the content of the frame buffer and determining a data element that, when used to process the content of the frame buffer, performs the determined type of processing;

the determined data element for processing comprises a first transformation element and a second transformation element;

the first transformation element is a three-dimensional (3D) LUT and the content of the 3D lookup table (LUT) is computed from the desired display settings and data stored in an ICC profile for the display;

the second transformation element is three one-dimensional (1D) lookup tables (LUTs) and the three 1D LUTs are computed from a mathematical model of the desired display settings;

processing the particular region using the second transformation element to generate a resultant region; and processing the resultant region using the first transformation element.

2. The display system according to claim 1, wherein:

determining the plurality of regions of the frame buffer comprises a user identifying a region and, for each identified region, the user selects desired display settings.

3. The display system according to claim 1, wherein the desired display settings for a particular determined region are determined based on characteristics of the particular determined region.

4. The display system of claim 3, wherein the characteristics of the particular region include at least one of:

whether pixels in the particular region are primarily greyscale, primarily color, or a mix of greyscale and color; or a name of the process controlling rendering of the particular region.

5. The display system according to claim 1, wherein each determined region comprises a geometric shape or a list of pixels representing the content provided by the at least one process.

6. The display system according to claim 1, wherein the processing procedure comprises at least one of color processing or luminance processing.

7. The display system of claim 6, wherein the processing procedure comprises luminance processing, which comprises:

applying a luminance scaling coefficient that is computed as the ratio of a requested luminance range to a native luminance range of the display.

8. The display system of claim 6, wherein the desired display settings for a particular determined region are based on sRGB, DICOM GSDF, or gamma 1.8.

9. The display system according to claim 1, wherein:

the display includes a physical sensor configured to measure light emitting from a measurement area of the display;

the display system varies in time the region of the content of the frame buffer displayed in the measurement area of the display; and the physical sensor measures and records properties of light emitting from each of the determined regions.

10. The display system according to claim 1, wherein:

the content of the frame buffer includes a plurality of windows;

the plurality of windows are managed by a window manager;

a location and size of each of the plurality of windows is received from the window manager;

determining the plurality of regions of the frame buffer comprises identifying each window of the plurality of windows as one of the plurality of regions.

11. The display system according to claim 10, wherein:

for each window of the plurality of windows, a particular process that provided the window is received from the window manager;

windows provided by a same process are combined into a single region.

12. A method for modifying content of a frame buffer prior to displaying the content of the frame buffer on a display, the method comprising:

receiving the content of the frame buffer;

determining a plurality of regions present in the content of the frame buffer which represent content provided by at least one process;

for each determined region, determining desired display settings for the content of the frame buffer located in the determined region;

generating processed frame buffer content by processing the received content of the frame buffer, the processing comprising:

for each determined region present in the content of the frame buffer:

determining a processing procedure to modify the content of the determined region such that, when visualized on the display, properties of the content of the determined region coincide with the desired display settings for the determined region;

processing the determined region using the determined processing procedure to generate processed frame buffer content;

supplying the generated processed frame buffer content to a display;

wherein, for a particular region of the determined regions:

determining the processing procedure includes determining a type of processing to perform on the content of the frame buffer and determining a data element that, when used to process the content of the frame buffer, performs the determined type of processing;

the determined data element for processing comprises a first transformation element and a second transformation element;

the first transformation element is a three-dimensional (3D) lookup table (LUT) and the content of the 3D LUT is computed from the desired display settings and data stored in an ICC profile for the display;

the second transformation element is three one-dimensional (1D) lookup tables (LUTs) and the three 1D LUTs are computed from a mathematical model of the desired display settings;

processing the particular region using the second transformation element to generate a resultant region; and processing the resultant region using the first transformation element.

13. The method according to claim 12, wherein:

determining the plurality of regions of the frame buffer comprises a user identifying a region and, for each identified region, the user selects desired display settings.

14. The method according to claim 12, wherein the desired display settings for a particular determined region are determined based on characteristics of the particular determined region.

15. The method of claim 14, wherein the characteristics of the particular region include at least one of:

whether pixels in the particular region are primarily greyscale, primarily color, or a mix of greyscale and color; or a name of the process controlling rendering of the particular region.

16. The method according to claim 12, wherein the processing procedure comprises at least one of color processing or luminance processing.

17. The method according to claim 12, further comprising:

recording measurements of light emitted from a measurement area of the display using a physical sensor;

varying in time the region of the content of the frame buffer displayed in the measurement area of the display; and recording properties of light emitting from each of the determined regions.

* * * * *